US005761324A

United States Patent [19]

Kanai et al.

[11] Patent Number: 5,761,324

[45] Date of Patent: Jun. 2, 1998

[54] PIEZOELECTRIC ACOUSTIC DEVICE

[75] Inventors: Yasuhiro Kanai; Hiroshi Ito; Fumihisa Ito, all of Tokyo, Japan

[73] Assignee: Taiyo Yuden Co., Ltd., Tokyo, Japan

[21] Appl. No.: 664,383

[22] Filed: Jun. 14, 1996

[30] Foreign Application Priority Data

Jun. 19, 1995 [JP] Japan ..... 7-175452

[51] Int. Cl.[6] ..... H04R 25/00

[52] U.S. Cl. ..... 381/190; 381/173; 381/191

[58] Field of Search ..... 381/173, 190, 381/191; 310/311, 324, 322

[56] References Cited

U.S. PATENT DOCUMENTS

| | | | |
|---|---|---|---|
| 4,295,009 | 10/1981 | Weidler | 179/110 A |
| 4,475,014 | 10/1984 | King | 179/110 A |
| 5,479,521 | 12/1995 | D'Avolio | 381/190 |

FOREIGN PATENT DOCUMENTS

| | | | |
|---|---|---|---|
| 6-86389 | 3/1994 | Japan | 381/190 |
| 6-86390 | 3/1994 | Japan | 381/190 |
| 595514 | 5/1994 | United Kingdom | 381/190 |

*Primary Examiner*—Wing F. Chan
*Assistant Examiner*—Rexford N. Barnie
*Attorney, Agent, or Firm*—Flynn, Thiel, Boutell & Tanis, P.C.

[57] ABSTRACT

A piezoelectric acoustic device comprises a case and a piezoelectric element which is accommodated in the case and has an inner peripheral surface thereof supported by an inner peripheral surface of the case at a middle portion thereof. A plurality of projections are provided on an inner peripheral surface of the case and spaced circumferentially along the inner peripheral surface of the case for supporting the peripheral portion of the piezoelectric element. A gap between the peripheral portion of the piezoelectric element and the inner peripheral surface of the case is closed by an elastic adhesive. A plurality of projections provided on and spaced circumferentially along the inner peripheral surface of the case contact the periphery of the piezoelectric element at the tips thereof, which restricts a radial movement of the piezoelectric element relative to the case. The piezoelectric acoustic device that is small-sized and is provided with the piezoelectric element having a small diameter can obtain oscillating frequency equivalent to that of a piezoelectric acoustic device provided with a piezoelectric element having a relatively large diameter.

22 Claims, 6 Drawing Sheets

PIEZOELECTRIC ACOUSTIC DEVICE

BACKGROUND OF THE INVENTION

1. Field of the Invention

The present invention relates to a piezoelectric acoustic device having a piezoelectric element adapted for use in an acoustic device such as a receiver of a telephone, etc.

2. Prior Art

A conventional piezoelectric acoustic device comprises a case like a tray for accommodating a piezoelectric element therein, a stepped piezoelectric element support provided on an inner peripheral side of the case at the intermediate portion thereof, wherein a peripheral portion of a diaphragm is placed on and fixed to the piezoelectric element support by an adhesive. The piezoelectric element comprises a diaphragm and a piezoelectric plate formed on a surface of the diaphragm and having electrodes at both surfaces thereof, lead wires connected to the electrode on the piezoelectric plate and to the diaphragm. The lead wires are extended outside the case.

With the progress of miniaturization of a portable telephone and a house hold telephone such as a cordless phone, a demand for miniaturization of the piezoelectric acoustic device adapted for a receiver is increased more and more.

In the conventional piezoelectric acoustic device, the diaphragm has a diameter of at least 27 ϕ, more in detail, diameter of about 32 ϕ. However, it is the mainstream that the diaphragm has a diameter of 20 ϕ or less.

However, when the diaphragm is reduced in its diameter while maintaining a thickness thereof, frequency characteristics of the diaphragm is shifted toward a high-frequency side so that a sound pressure in a low-frequency side is reduced. Accordingly, in the conventional piezoelectric acoustic device having the aforementioned structure, if a diameter of the diaphragm is 20 ϕ or less, a high sound pressure is not obtained at a frequency band having 0.5 kHz or less. In a receiver employing the piezoelectric acoustic device having such frequency-sound pressure characteristics, a noise and a high sound such as high-pitched voice alone is emphasized, which leads to a drawback in that a reproduction sound which is unnatural and difficult to hear is emitted.

Meanwhile, it is necessary to reduce an overall thickness of a piezoelectric acoustic device by a reduced thickness of the piezoelectric element in order to improve such acoustic characteristics and obtain acoustic characteristics equivalent to that of the piezoelectric acoustic device employing piezoelectric element having a small diameter provided with a diaphragm having a relatively large diameter. However, it is necessary to reduce the thickness of piezoelectric ceramic and a diaphragm in order to thin the thickness of the piezoelectric element as a whole, which leads to reduction of strength of the piezoelectric element. That is, the piezoelectric acoustic device is likely to be troubled because of the reduction of strength, which deteriorates a manufacturing yield, and hence the reduction of the thickness of the piezoelectric acoustic device has its limit.

SUMMARY OF THE INVENTION

In view of the aforementioned drawbacks, it is an object of the invention to provide a piezoelectric acoustic device which is small-sized and is provided with a piezoelectric element having a small diameter capable of obtaining oscillating frequency equivalent to that of a piezoelectric acoustic device provided with a piezoelectric element having a relatively large diameter, and capable of emitting natural reproduced sound.

To achieve the above object, the present invention is structured in that an entire peripheral portion of a diaphragm 21 of a piezoelectric element 2 is not directly supported by an inner peripheral surface of a case 1 but the peripheral portion of the diaphragm 21 is supported by the inner peripheral surface of the case 1 at several portions thereof, and a gap defined between the peripheral portion of the diaphragm 21 and the inner peripheral surface of the case 1 is closed by an elastic adhesive 14.

That is, the piezoelectric acoustic device of the present invention comprises the case 1 and the piezoelectric element 2 which is accommodated in the case 1 and has an inner peripheral surface thereof supported by an inner peripheral surface of the case 1 at a middle portion thereof, wherein it is characterized by a plurality of projections 15, 15 . . . which are provided on an inner peripheral surface of a step portion 12 of the case 1, described later, and spaced circumferentially along the inner peripheral surface of a step portion 12, a gap between the peripheral portion of the piezoelectric element 2 and the inner peripheral surface of the case 1 is closed by the elastic adhesive 14. Further, a plurality of projections 13, 13 . . . , which are provided on the inner peripheral surface of the case 1 and spaced circumferentially along the inner peripheral surface of the case 1, contact the periphery of the piezoelectric element 2 at the tips thereof, which restricts radial movement of the piezoelectric element 2 relative to the case 1.

Meanwhile, the piezoelectric acoustic device is structured in that a plurality of projections 17, 17 . . . are provided on a peripheral portion of the piezoelectric element 2 and are spaced circumferentially along the peripheral portion thereof instead of the projections 13, 13 . . . provided on the inner peripheral surface of the case 1, so that the peripheral portion of the piezoelectric element 2 is supported by the projections 17, 17 . . . . In this case, tips of the projections 17, 17 . . . , which are provided on and spaced circumferentially along the peripheral portion of the piezoelectric element 2, contact the inner peripheral surface of the case 1, whereby the projections 17, 17 . . . restrict radial movement of the piezoelectric element 2 relative to the case 1. Further, the step portion 12 for holding the elastic adhesive 14 is provided on the inner peripheral surface of the case 1 so as to fix the elastic adhesive 14 to the inner peripheral surface of the case 1 at a given position thereof.

There are two types of supporting systems as a structure to incorporate the piezoelectric element 2 into the case 1, namely, a so-called peripheral fixing system for completely fixing the entire portion of the piezoelectric element 2 to the case 1, and a so-called peripheral supporting system for merely supporting the peripheral portion of the piezoelectric element 2 but not fixing it to the case 1. The peripheral fixing system means a state where it completely restrains the oscillation of the diaphragm 21 by fixing the peripheral portion of the diaphragm 21 of the piezoelectric element 2, so that the peripheral portion of the fixed diaphragm 21 is not inclined. The peripheral supporting system means a state where it restrains the floating movement of the diaphragm 21 in the thickness direction and the plane direction of the diaphragm 21 alone, but it does not restrain the oscillation of the peripheral portion of the diaphragm 21, so that the peripheral portion of the fixed diaphragm 21 is permitted to be inclined.

An oscillating frequency of the diaphragm 21 when the piezoelectric element 2 is incorporated into the case 1 in a state where the peripheral portion of the diaphragm 21 is fixed in the peripheral fixing system or peripheral supporting system is generally expressed as follows.

$$\omega_1=\alpha_1^2 hY^{1/2}/a^2\{3\rho(1-\sigma^2)\}^{1/2}$$

where $\omega_1$ is a primary resonance frequency, $\alpha_1$ is a standard constant of the primary resonance, h is a thickness of the diaphragm, Y is modulus of elasticity of the diaphragm, a is radius of the diaphragm, $\rho$ is a density of the diaphragm, and $\sigma$ is Poisson's ratio.

In the expression of the resonance frequency, the primary frequency standard constant $\alpha_1$ in the peripheral supporting system is approximately twice as large as that in the peripheral fixing system. That is, when the diaphragm 21 of the piezoelectric element 2 is supported in the peripheral supporting system, the diaphragm 21 having the diameter of 70% of that in the peripheral fixing system can obtain the same resonance frequency as that in the peripheral fixing system.

As mentioned above, the present invention is structured in that an entire peripheral portion of the diaphragm 21 of the piezoelectric element 2 is not directly supported by the inner peripheral surface of the case 1 but the peripheral portion of the diaphragm 21 is supported at several portions of the inner peripheral surface of the case 1, and a gap between the inner peripheral portion of the diaphragm 21 and the inner peripheral surface of the case 1 is closed by the elastic adhesive 14, the peripheral potion of the diaphragm 21 of the piezoelectric element 2 is close to an ideal peripheral supporting system. That is, oscillation of the peripheral portion of the diaphragm 21 is not restrained and its inclination is allowed, and hence the structure is substantially the same as that in the peripheral supporting system.

As mentioned above, the piezoelectric acoustic device provided with a piezoelectric element having a small diameter can obtain an oscillating frequency equivalent to an oscillating frequency of a piezoelectric acoustic device provided with a piezoelectric element having a relatively large diameter, so that natural sound can be obtained. As a result, it is possible to efficiently manufacture a piezoelectric acoustic device which is excellent in the acoustic characteristics even if it is miniaturized.

PREFERRED EMBODIMENT OF THE INVENTION

Figure 1:
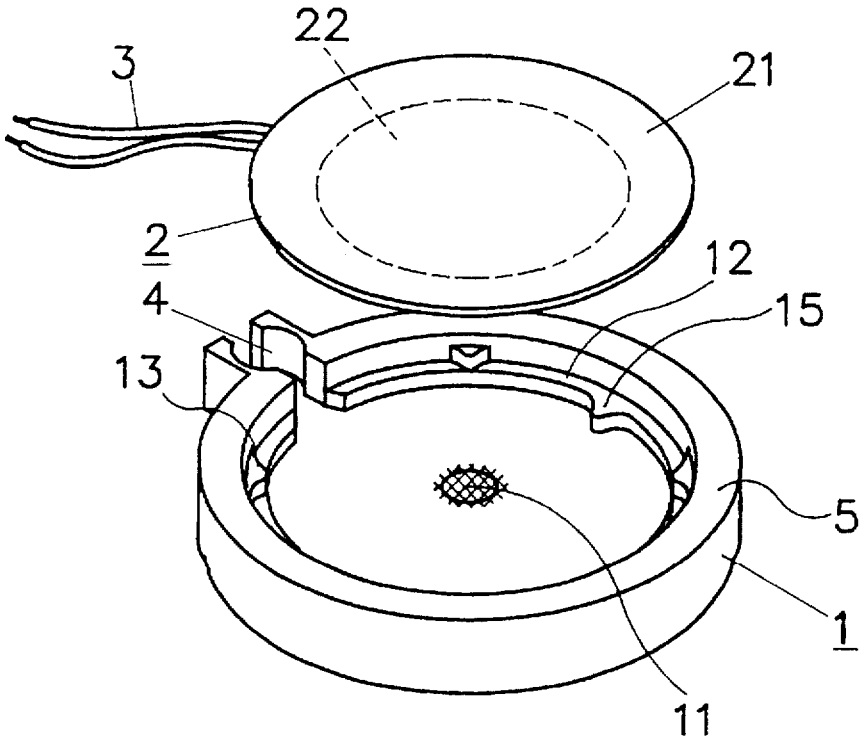
FIG. 1 is a perspective view showing a state where a case is separate from a piezoelectric acoustic element according to a piezoelectric acoustic device of a first embodiment of the invention.

First to third embodiments and the modifications of the present invention will be now described with reference to the attached drawings. In these embodiments and modifications, same elements are denoted at the same reference numerals.

A piezoelectric acoustic device according to a first embodiment of the present invention will be now described with reference to FIGS. 1 through 4, wherein the present invention is applied to a piezoelectric receiver. A case 1 is formed like a tray and having an upper opened surface and made of resins. A sound damper 11 comprises a hole which is bored at the central bottom portion of the case 1 and is covered with a mesh. The case 1 has a lead wire groove 4 at a portion of a peripheral wall 5.

A step portion 12 is formed on the peripheral wall 5 at a middle portion thereof in a direction of the height thereof and extends along an entire periphery thereof excepting a portion where the lead wire groove 4 is provided. A plurality of projections 15, 15 . . . project from four portions of the inner periphery of the step portion 12 toward the center of the case 1. A plurality of projections 13, 13 . . . project from the inner surface of the peripheral wall 5 over the step portion 12 for centering the piezoelectric element 2. In the first embodiment, the projections 13, 13 . . . and the projections 15, 15 . . . are respectively provided on the inner surface of the peripheral wall 5 of the case 1 and they are respectively arranged at an angular interval of 90° between the projections 13 and 13 and between the projections 15 and 15 but they are arranged out of position at an angular interval of 45° between the projections 13 and the projections 15.

The piezoelectric element 2 comprises a metallic diaphragm 21 and a piezoelectric plate 22 which is formed of piezoelectric body ceramic and has electrode layers at both main surfaces thereof and is fixed to the diaphragm 21. Lead wires 3 are soldered to the diaphragm 21 and the electrode of the piezoelectric plate 22. It is ideal that a diameter of the diaphragm 21 of the piezoelectric element 2 is substantially the same as the inner diameter of the step portion 12, and it is slightly less than each interval of the confronted projections 13, 13 . . . but slightly greater than each interval of the confronted projections 15, 15....

Figure 3:
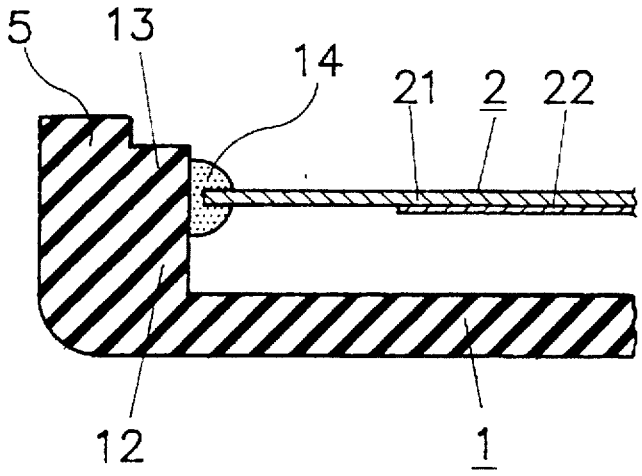
FIG. 3 is a longitudinal cross-sectional side view of a main portion of a part A in FIG. 2 showing a state where a periphery of a diaphragm is supported by an elastic adhesive in the piezoelectric acoustic device of the first embodiment.
Figure 4:
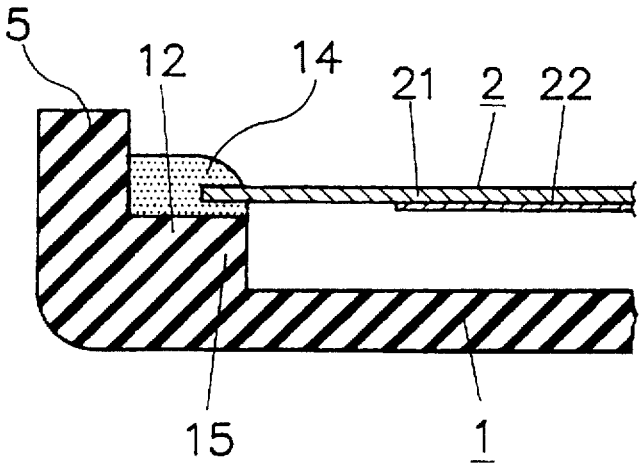
FIG. 4 is a longitudinal cross-sectional side view of a main portion of a part B in FIG. 2 showing a state where a periphery of a diaphragm is supported by an elastic adhesive in the piezoelectric acoustic device of the first embodiment.

An elastic adhesive 14 such as a silicon adhesive, etc. is uniformly coated along the step portion 12 of the inner peripheral side of the peripheral wall 5 of the case 1 as shown in FIGS. 3 and 4. The elastic adhesive 14 is held by the step portion 12 so that it is prevented from sagging. Next, the piezoelectric element 2 is accommodated inside the case 1, and a peripheral portion of the diaphragm 21 of the piezoelectric element 2 is embedded in the elastic adhesive 14. In this case, the piezoelectric element 2 is centered toward the center of the case 1 by tips of the projections 13, 13 . . .so that the diaphragm 21 is restricted to move in a radial direction. Accordingly, the piezoelectric element 2 is accommodated concentrically in the case 1. As shown in FIG. 4, the peripheral of the diaphragm 21 is placed on the projections 15, 15 . . . by way of the elastic adhesive 14. The lead wires 3 are led outside the case 1 from the lead wire groove 4.

Figure 2:
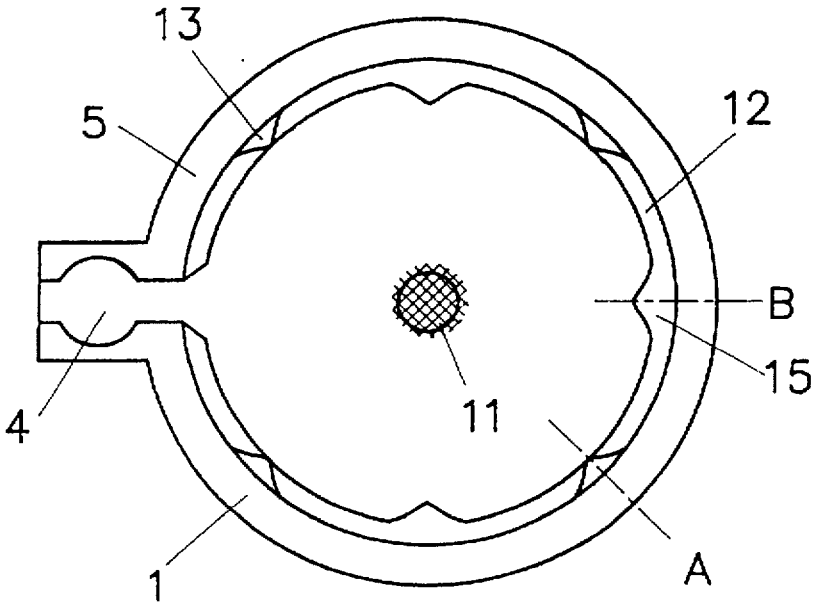
FIG. 2 is a plan view of the case of the piezoelectric acoustic device of FIG. 1.

FIG. 3 shows a cross-sectional view showing a part denoted at A in FIG. 2. and FIG. 4. is a cross-sectional view showing a part denoted at B in FIG. 2.

In such a supporting structure of the piezoelectric element 2, the peripheral portion of the diaphragm 21 is not fixed to the peripheral wall 5 of the case 1 but several portions of the diaphragm 21 are supported by the projections 13, 13 . . . and the projections 15, 15 . . . by way of the elastic adhesive 14. Accordingly, this structure is close to an ideal peripheral supporting system in which the oscillation of the peripheral portion of the diaphragm 21 is restrained. As the result, a desired resonance frequency is obtained even by the diaphragm 21 having a small diameter.

Figure 5:
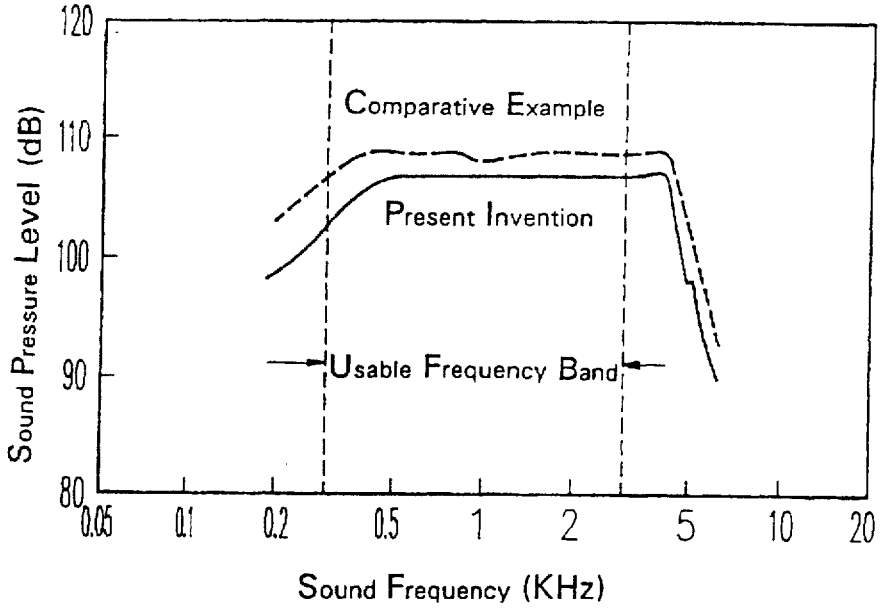
FIG. 5 is a graph showing frequency-sound pressure level characteristics in the piezoelectric acoustic device of the present invention and that in a piezoelectric acoustic device of a comparative example.

FIG. 5. shows acoustic characteristics between the piezoelectric acoustic device of the present invention and a piezoelectric acoustic device of a comparative example. A solid line shows a frequency-sound pressure level of a piezoelectric receiver which is attached to the case 1 as shown in FIGS. 1. through 4, employing the piezoelectric element 2 attaching thereto the piezoelectric plate 22 comprising a PZT piezoelectric ceramic having a diameter of 12 mm and a thickness of 0.05 mm and including electrodes at both surfaces thereof. The frequency-sound pressure level is measured by an IEC-318 coupler to which an earpiece which acoustically optimizes the piezoelectric receiver. A broken line shows a frequency- sound pressure level of a piezoelectric receiver which is attached to a case in a peripheral fixing system employing the piezoelectric element 2 attaching thereto a piezoelectric plate comprising a PZT piezoelectric ceramic having a diameter of 15 mm and a thickness of 0.05 mm including electrodes at both surfaces thereof.

As evident from the result of comparison, there is a difference in sound pressure level between the piezoelectric receiver according to the embodiment of the present invention and the piezoelectric receiver according the comparative example, but there is no substantial difference in frequency band therebetween, namely, the frequency band where a high sound pressure is obtained is almost the same therebetween.

Figure 6:
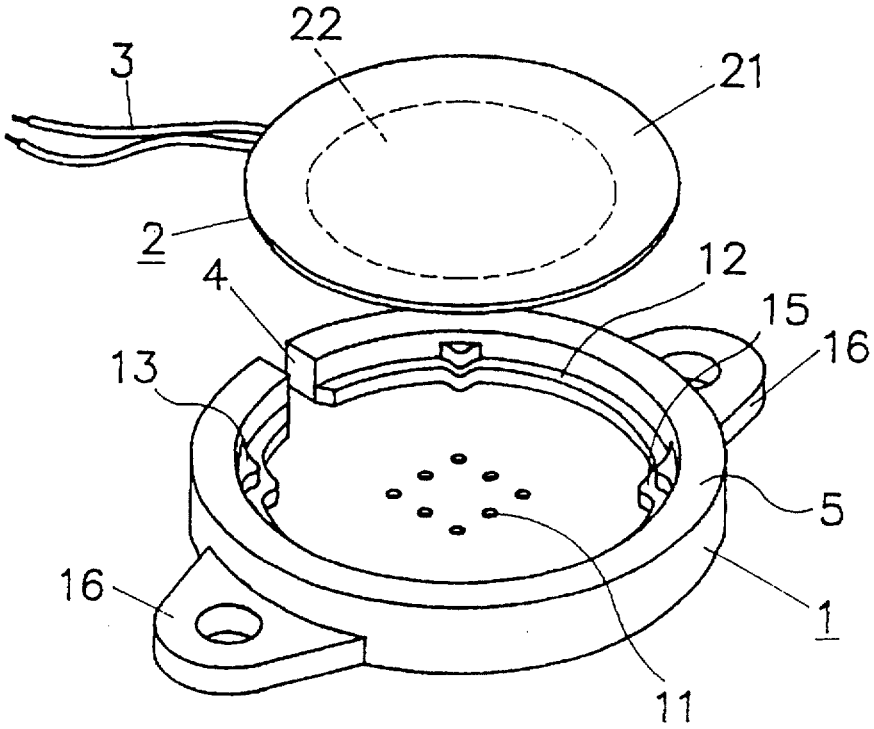
FIG. 6 is a perspective view showing a state where a case is separate from a piezoelectric acoustic element according to a piezoelectric acoustic device of a second embodiment of the invention.
Figure 7:
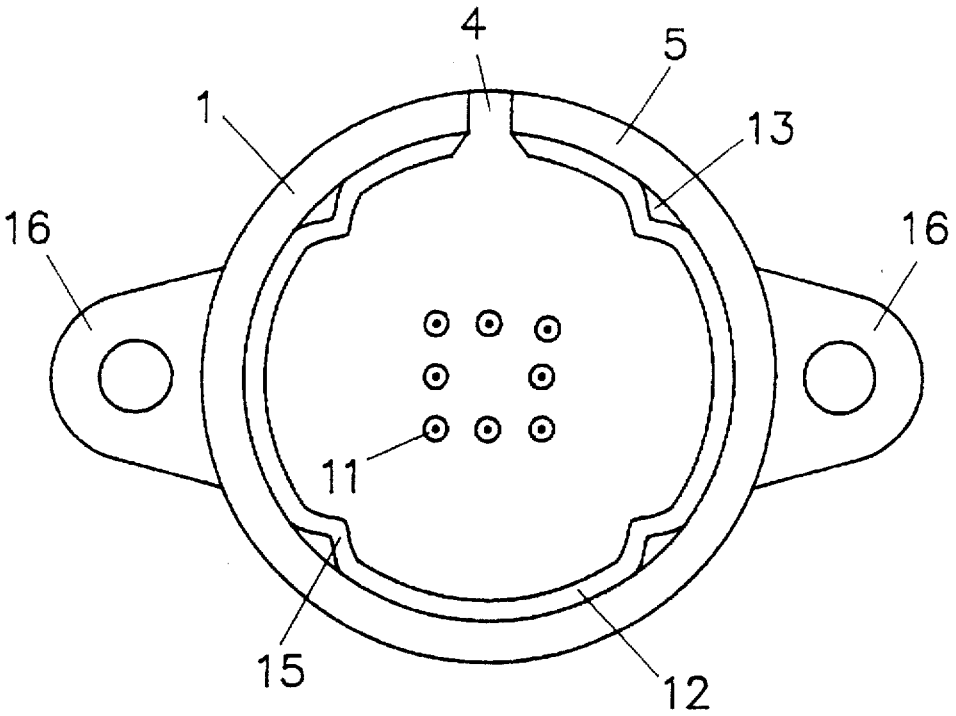
FIG. 7 is a plan view of the case of the piezoelectric acoustic device of FIG. 6.

A piezoelectric acoustic device according to a second embodiment will be now described with reference to FIG. 6. and 7 wherein FIG. 7 shows a case 1 of the piezoelectric acoustic device.

The projections 13, 13 . . . and the projections 15, 15 . . . are displaced from one another at angular intervals of 45° in the first embodiment, but they are respectively arranged on the inner side of the peripheral wall 5 of the case 1 at the same positions at angular intervals of 90°. Further, the case 1 of the piezoelectric acoustic device according the second embodiment, two attaching brackets 16, 16 are formed radially and extend from the lower peripheral portion of the peripheral wall 5. The piezoelectric acoustic device which is completed in a state where the piezoelectric element (not shown in FIG. 7.) is attached inside the case 1 is used by attaching the case 1 to the piezoelectric acoustic device buy way of screw holes of defined in the attaching brackets 16, 16.

Since the projections 13, 13 . . . and the projections 15, 15 . . . are provided at the same positions, it is advantageous that the elastic adhesive 14 can be coated continuously uniformly on the step portion 12 using a dispenser, etc.

Figure 8A:
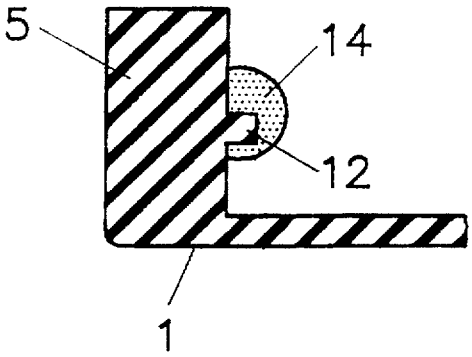
FIG. 8(*a*) and 8(*b*) are longitudinal cross-sectional side views each showing a main portion of a case in a state where an elastic adhesive is coated on a step portion of another example provided on a peripheral wall of the case according to the piezoelectric acoustic device of the present invention.
Figure 8B:
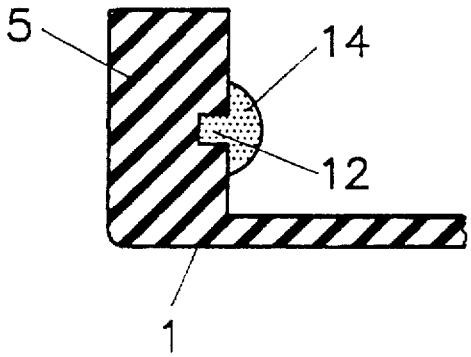
Figure 9A:
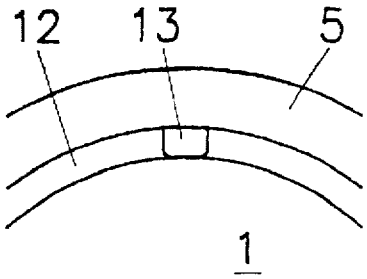
FIGS. 9(*a*), 9(*b*), 9(*c*) and 9(*d*) are views showing other examples of projections provided on a peripheral wall of the case according to the piezoelectric acoustic device of the present invention.
Figure 9B:
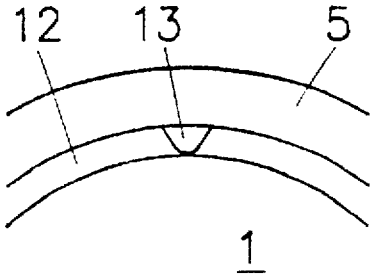
Figure 9C:
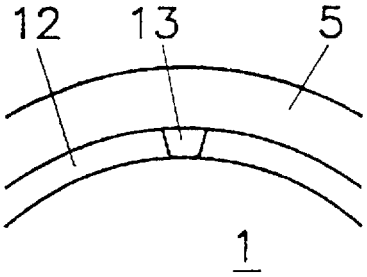
Figure 9D:
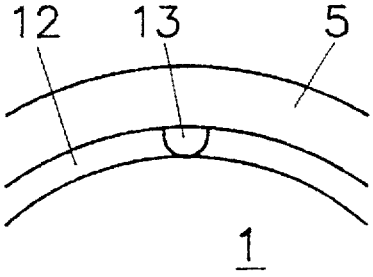

FIGS. 8(*a*) and 8(*b*) depict a modification of the step portion 12 of the case 1 according to the piezoelectric acoustic device. In the embodiment, the step portion 12 comprises a wall surface which rises from a bottom surface to an inner surface of the peripheral wall 5 and a circumferential surface crossing at right angles with wall surface. As mentioned, the step portion 12 is provided to hold the elastic adhesive 14 at the given positions. In the case 1 shown in FIGS. 8(*a*) and 8(*b*), the step portion 12 is formed of various concave and convex grooves. In such a step portion 12, a surface area of an inner surface of the peripheral wall 5 of the case 1 is increased, it is advantageous to hold and fix the elastic adhesive 14 having viscosity to some extent to the step portion 12.

FIGS. 9 (*a*) through (*d*) show other examples of the shapes of the projections 13, 13 . . . FIG. 9(*a*) shows an example where square and projections 13, 13 . . . are provided, FIG. 9. (*b*) shows an example where triangular ridged projections 13, 13 . . . are provided, FIG. 9. (*c*) shows an example where trapezoidal ridged projections 13, 13 . . . are provided, and FIG. 9. (*d*) shows an example where semicircular ridged projections 13, 13 . . . are provided.

Even if the tips of projections 13, 13 . . . contact the peripheral portion of the diaphragm 21, it is preferable to select the shape of the tip having an area which becomes as small as possible. Accordingly, the shape of FIG. 9(*b*) is most preferable among the shapes of the tips shown in FIGS. 9(*a*) through (*d*) since it has a small contact area, more in detail, it contacts the periphery of the diaphragm 21 by a point or a line when the projections 13, 13 . . . contact the periphery of the diaphragm 21 of the piezoelectric element 2. The number of such projections 13, 13 . . . provided along the peripheral wall of the case 1 is at least three but is preferable to be six or less since if the number is increased, a force to restrain the peripheral portion of the diaphragm 21 is strengthened.

Figure 10:
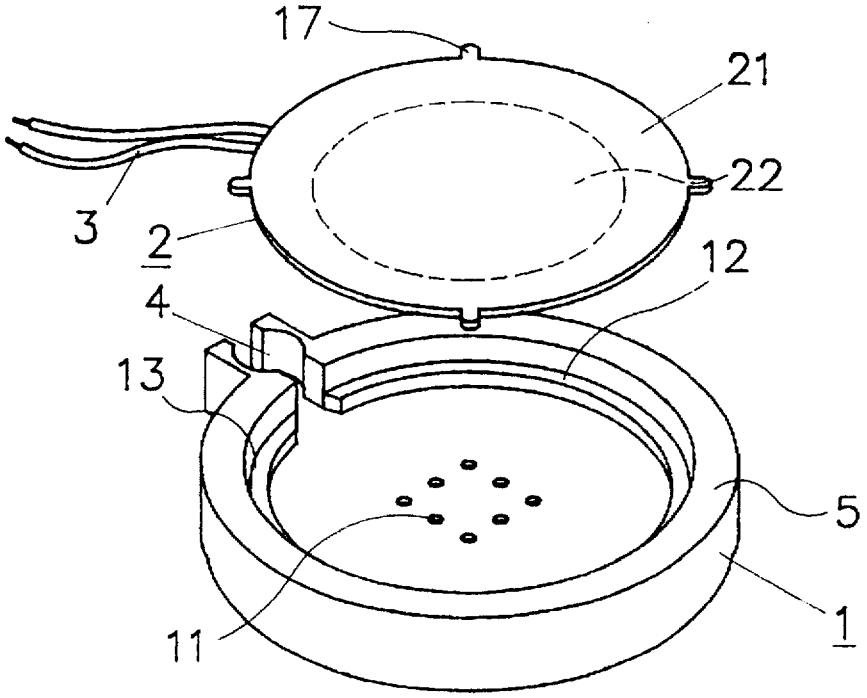
FIG. 10 is a perspective view showing a state where a case is separated from a piezoelectric acoustic element according to a piezoelectric acoustic device of a third embodiment of the invention.
Figure 11:
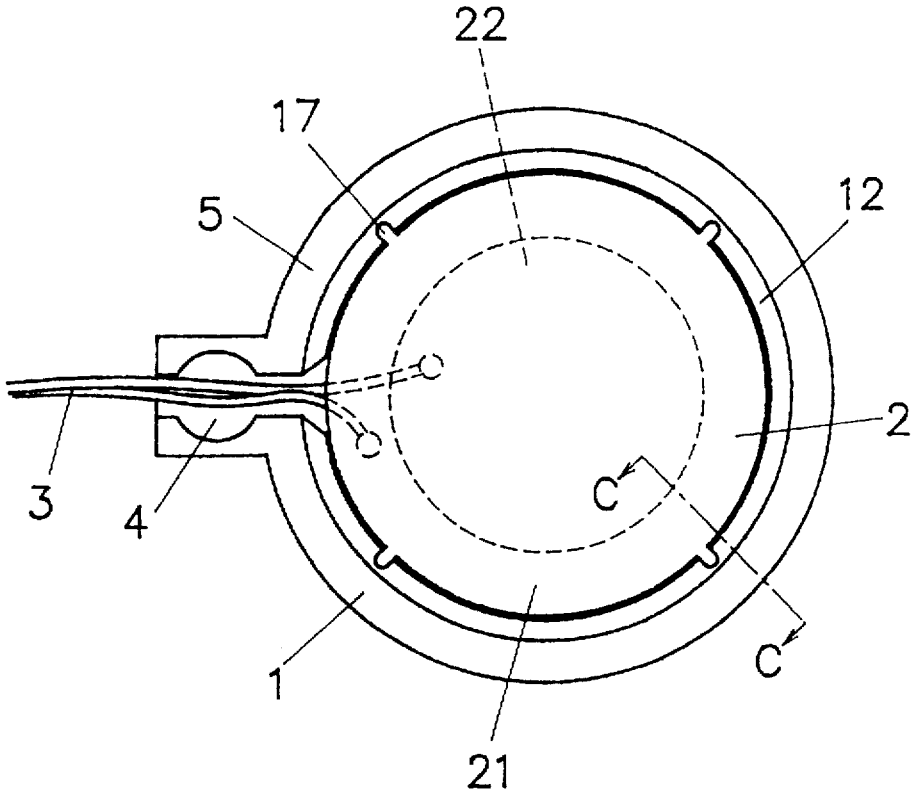
FIG. 11 is a plan view of the case of the piezoelectric acoustic device of FIG. 10.
Figure 12:
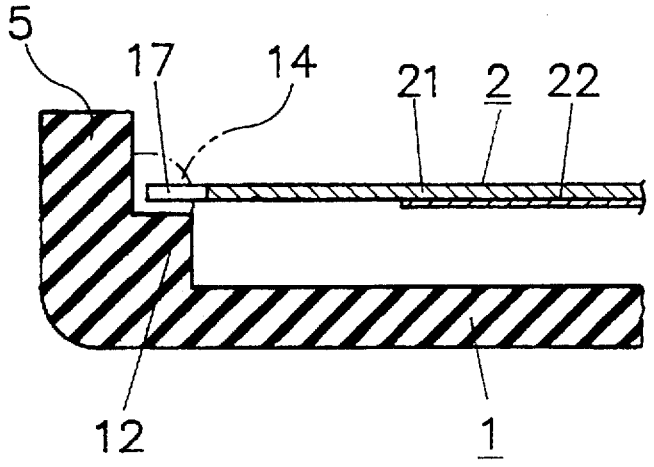
FIG. 12 is a longitudinal cross-sectional side view of a main portion taken along a line C—C in FIG. 11 showing a state where a periphery of a diaphragm is supported by an elastic adhesive in the piezoelectric acoustic device of the third embodiment.

A piezoelectric acoustic device according to a third embodiment will be now described with reference to FIGS. 10 through 12.

In the first and second embodiments, a plurality of projections 13, 13 . . . for centering purpose are provided from the inner peripheral surface of the peripheral wall 5 of the case 1 and a plurality of supporting projections 15, 15 . . . are provided on the inner peripheral surface of the step portion 12. However, in the third embodiment, such projections 13, 13 . . . and projections 15, 15 . . . are not provided but a plurality of projections 17, 17 . . . are radially provided on an outer peripheral surface of the diaphragm 21 of the piezoelectric element 2. There are provided four projections 17, 17 . . . in FIGS. 10 and 11.

A diameter of the diaphragm 21 of the piezoelectric element 2 excepting the peripheral portion, i.e. the projections 17, 17 . . . is substantially the same as or slightly less than the inner diameter of the step portion 12. Each interval between the confronted tips of the projections 17, 17 . . . is slightly less than the inner diameter of the peripheral wall 5 of the case 1 and slightly greater than the inner diameter of the step portion 12. Accordingly, in a state where the piezoelectric element 2 is accommodated inside the case 1 while the projections 17, 17 . . . thereof is placed on the step portion 12, the projections 17, 17 . . . are supported by the step portion 12 from the lower side of the step portion 12, and the piezoelectric element 2 is centered toward the center of the case 1 by its own projections 17, 17 . . . so that the piezoelectric element 2 is restricted to move radially. In the third embodiment, the elastic adhesive 14 is previously uniformly coated on the step portion 12, then the projections 17, 17 . . . of the diaphragm 21 are placed on and supported by the step portion 12, which is fundamentally the same as the first and second embodiments.

In such a supporting structure of the piezoelectric element 2, the periphery of the diaphragm 21 is not fixed to the peripheral wall 5 of the case 1 and the projections 17, 17 . . . thereof are supported by the step portion 12 by way of the elastic adhesive 14. Accordingly, the resonance of the diaphragm 21 at the periphery thereof is not restrained, and hence it is close to an ideal peripheral supporting system. As a result, it is possible to obtain a desired resonance frequency even if the diaphragm 21 has a small diameter.

The present invention is not limited to the aforementioned embodiments and modifications. For example, although the sound damper 11 is formed of a sound emitting hole which is covered with the meshe in the first embodiment or formed of a plurality of small sound emitting holes in the second embodiment, such hole or holes may not be formed, or a single relatively large sound emitting hole may be provided. Further, in place of the lead extension groove 4, a lead extension hole may be provided, or a groove or hole is not provided, or a lead wire 3 is extended from the opening of the case 1.

What is claimed is:

1. A piezoelectric acoustic device comprising a case, a piezoelectric element accommodated in the case, said piezoelectric element having a peripheral portion with a diameter supported by an inner peripheral surface of said case at a middle portion of said case, the piezoelectric acoustic device further comprising:

a step portion forming the inner peripheral surface of said case, said step portion having an inner diameter which is substantially equal to the diameter of said peripheral portion of said piezoelectric element; and a plurality of projections provided on and spaced circumferentially along the inner peripheral surface of the case or a plurality of projections provided on and spaced circumferentially along the peripheral portion of the piezoelectric element, wherein said projections of said case or said projections of said piezoelectric element support the peripheral portion of said piezoelectric element; and wherein the peripheral portion of the piezoelectric element and an inner wall of said step portion define a gap therebetween and an adhesive agent extends between the peripheral portion of said piezoelectric element and said step portion to close said gap.

2. The piezoelectric acoustic device according to claim 1, wherein the plurality of projections for supporting the piezoelectric element project from the inner wall of said step portion of the case toward the center of the case, and wherein the peripheral portion of the piezoelectric element is seated on the projections.

3. The piezoelectric acoustic device according to claim 1, wherein the plurality of projections for supporting the piezoelectric element project outwardly from the peripheral portion of the piezoelectric element, and the projections are seated on and supported by said step portion of said case.

4. The piezoelectric acoustic device according to claim 1, further comprising a plurality of stabilizing projections provided on and spaced circumferentially along the inner peripheral surface of the case for restricting radial movement of the piezoelectric element relative to the case.

5. The piezoelectric acoustic device according to claim 4, wherein tips of said stabilizing projections contact a periphery of the piezoelectric element.

6. A piezoelectric acoustic device according to claim 1, wherein the plurality of projections provided on and spaced circumferentially along the peripheral portion of the piezoelectric element restrict radial movement of the piezoelectric element relative to the case.

7. A piezoelectric acoustic device according to claim 6, wherein tips of the projections contact the inner peripheral surface of the case.

8. The piezoelectric acoustic device according to claim 1, wherein said adhesive is an elastic adhesive.

9. The piezoelectric acoustic device according to claim 4, wherein at least one said stabilizing projection is aligned with one said projection that supports the peripheral portion of said piezoelectric element.

10. A piezoelectric acoustic device comprising:

a case, said case having a center, a raised peripheral wall with an inner surface that is directed towards said center and a top surface, a step portion that extends inwardly from said inner surface of said peripheral wall towards said center and that is located below said top surface of said peripheral wall, said step portion having an inner diameter and a plurality of support projections integrally formed with said step portion that extend inwardly toward said center;

a piezoelectric element, said piezoelectric element having a peripheral edge with a diameter, said diameter being substantially equal to the inner diameter of said step portion, wherein said piezoelectric element is seated on said support projections so as to define a gap between said peripheral edge of said piezoelectric element and said step portion; and an elastic adhesive extending between said step portion and said peripheral edge of said piezoelectric element to close the gap.

11. The piezoelectric acoustic device of claim 10, wherein said case is further formed with a plurality of stabilizing projections that extend inwardly from said inner surface of said peripheral wall above said step portion, each said stabilizing projection being formed with an inwardly directed tip.

12. The piezoelectric acoustic device of claim 11, wherein said tips of said stabilizing projections contact said peripheral edge of said piezoelectric element.

13. The piezoelectric acoustic device of claim 11, wherein said stabilizing projections are aligned with said support projections.

14. The piezoelectric acoustic device of claim 11, wherein said stabilizing projections are shaped to have a cross-sectional profile that is triangular.

15. The piezoelectric acoustic device of claim 11, wherein said stabilizing projections are shaped to have a cross-sectional profile that is semi-circular.

16. The piezoelectric acoustic device of claim 10, wherein said adhesive is a silicon adhesive.

17. The piezoelectric acoustic device of claim 10, wherein said case is provided with four said support projections.

18. The piezoelectric acoustic device of claim 10, wherein said support projections are equangularly circumferentially spaced apart from each other.

19. A piezoelectric acoustic device comprising:

a case, said case having a center, a raised peripheral wall with an inner surface that is directed towards said center and a top surface and a step portion that extends inwardly from said inner surface of said peripheral wall towards said center and that is located below said top surface of said peripheral wall, said step portion having an inner diameter;

a piezoelectric element, said piezoelectric element having a peripheral edge with a diameter, said diameter being substantially equal to the inner diameter of said step portion and a plurality of support projections that extend radially beyond said peripheral edge wherein said piezoelectric element is positioned in said case so that said support projections are seated on said step portion of said case and is further positioned to define a gap between said peripheral edge of said piezoelectric element and said step portion; and an elastic adhesive extending between said step portion and said peripheral edge of said piezoelectric element to close the gap.

20. The piezoelectric acoustic device of claim 19, wherein said piezoelectric element is provided with four said support projections.

21. The piezoelectric acoustic device of claim 19, wherein said support projections are equangularly circumferentially spaced apart from each other.

22. The piezoelectric acoustic device of claim 19, wherein said adhesive is a silicone adhesive.

* * * * *